US009475668B2

(12) United States Patent
Barea

(10) Patent No.: US 9,475,668 B2
(45) Date of Patent: Oct. 25, 2016

(54) MODULAR ELEMENT FOR A CREEL

(71) Applicant: BTSR INTERNATIONAL S.P.A., Olgiate Olona (Varese) (IT)

(72) Inventor: Tiziano Barea, Busto Arsizio (IT)

(73) Assignee: BTSR INTERNATIONAL S.P.A., Olgiate Olona (Varese) (IT)

( * ) Notice: Subject to any disclaimer, the term of this patent is extended or adjusted under 35 U.S.C. 154(b) by 63 days.

(21) Appl. No.: 14/437,303

(22) PCT Filed: Nov. 5, 2013

(86) PCT No.: PCT/IB2013/059915
§ 371 (c)(1),
(2) Date: Apr. 21, 2015

(87) PCT Pub. No.: WO2014/076608
PCT Pub. Date: May 22, 2014

(65) Prior Publication Data

US 2015/0291383 A1 Oct. 15, 2015

(30) Foreign Application Priority Data

Nov. 14, 2012 (IT) ..... MI2012A1929

(51) Int. Cl.

| | |
|---|---|
| ***B65H 49/16*** | (2006.01) |
| ***D02H 1/00*** | (2006.01) |
| ***B65H 59/38*** | (2006.01) |
| ***B65H 67/02*** | (2006.01) |
| ***B65H 63/08*** | (2006.01) |
| ***B65H 49/12*** | (2006.01) |

(52) U.S. Cl.
CPC ..... *B65H 49/16* (2013.01); *B65H 49/12* (2013.01); *B65H 59/38* (2013.01); *B65H 59/388* (2013.01); *B65H 63/086* (2013.01); *B65H 67/02* (2013.01); *D02H 1/00* (2013.01); *B65H 2701/31* (2013.01)

(58) Field of Classification Search
CPC .... B65H 49/12; B65H 49/16; B65H 49/328; B65H 2701/31; B65H 67/02; D02H 1/00
See application file for complete search history.

(56) References Cited

U.S. PATENT DOCUMENTS

| | | | |
|---|---|---|---|
| 1,833,591 | A | 11/1931 | Remington et al. |
| 2,710,155 | A | 6/1955 | Borges et al. |
| 3,773,274 | A | 11/1973 | Wildi |
| 6,676,054 | B2 | 1/2004 | Heaney et al. |
| 2012/0217337 | A1 | 8/2012 | Barea |

FOREIGN PATENT DOCUMENTS

| | | | |
|---|---|---|---|
| WO | 2011061602 | A1 | 5/2011 |

OTHER PUBLICATIONS

International Search Report and Written Opinion mailed Jan. 20, 2014 for PCT/IB2013/059915 to BTSR International S.P.A. filed Nov. 5, 2013.

*Primary Examiner* — William E Dondero
(74) *Attorney, Agent, or Firm* — Vorys, Sater, Seymour and Pease LLP

(57) ABSTRACT

A modular element for a creel includes a structure having at least one support for supporting a package or bobbin of yarn; the structure being modularly couplable with other similar structures to allow the feeding of multiple yarns to a textile machine; a feeding device for the yarn to draw the yarn from the bobbin and supply it to the textile machine; the support is movable parallel to a movement direction, defined from a rear face to a front face of the structure, between a position inside the structure and a position outside the structure.

10 Claims, 6 Drawing Sheets

MODULAR ELEMENT FOR A CREEL

CROSS-REFERENCE TO RELATED APPLICATIONS

This is a §371 National Stage Application of International Application No. PCT/IB2013/059915 filed on Nov. 5, 2013, claiming the priority of Italian Patent Application No. MI2012A001929 filed on Nov. 14, 2012.

The present invention is relative to a modular element for a creel.

As is known, a creel is a structure that supports a plurality of bobbins or packages from which threads are unwound that are directed to a textile machine for the processing thereof, such as a diaper production line.

Modular creels are known having a plurality of supports that can be coupled to each other and carrying a further plurality of movable pins in which the bobbins can be arranged. Such pins facilitate the loading of the packages. Such supports are also associated with thread guides that allow directing the threads that are unwound from the packages, in a guided manner, towards a textile machine.

Such modular creels can form cabinets of various size, ventilated or non-ventilated. Nevertheless, such structures have large size, being extended both vertically and horizontally.

One example of such modules for a creel is described in the U.S. Pat. No. 6,676,054. This regards a device for unwinding an elastomeric thread from a bobbin according to a method for feeding the thread of head-tail type, i.e. connecting the end of the thread of one bobbin with the start of the thread of another bobbin. The latter are supported by pins associated with uprights defining a structure with definite, non-negligible size.

Other examples of such elements are described in the documents WO 2011/061602 and U.S. Pat. No. 2,710,155.

This constitutes a real drawback of the known creels since, as is known, when it is necessary to feed a high number of threads, the creels can assume truly large sizes. This can determine considerable problems where the spaces available are limited.

In this context, the technical task underlying the present invention is to propose a modular element for a creel which overcomes the abovementioned drawback of the prior art.

In particular, object of the present invention is to provide a modular element for a creel which allows preparing creels capable of managing a high number of yarns with a reduced bulk.

The specified technical task and object are substantially achieved by a modular element for a creel comprising the technical characteristics set forth in one or more of the enclosed claims.

Further characteristics and advantages of the present invention will be clearer from the exemplifying and hence non-limiting description of a preferred but not exclusive embodiment of a modular element for a creel, as illustrated in the enclosed drawings, in which.

Figure 1:
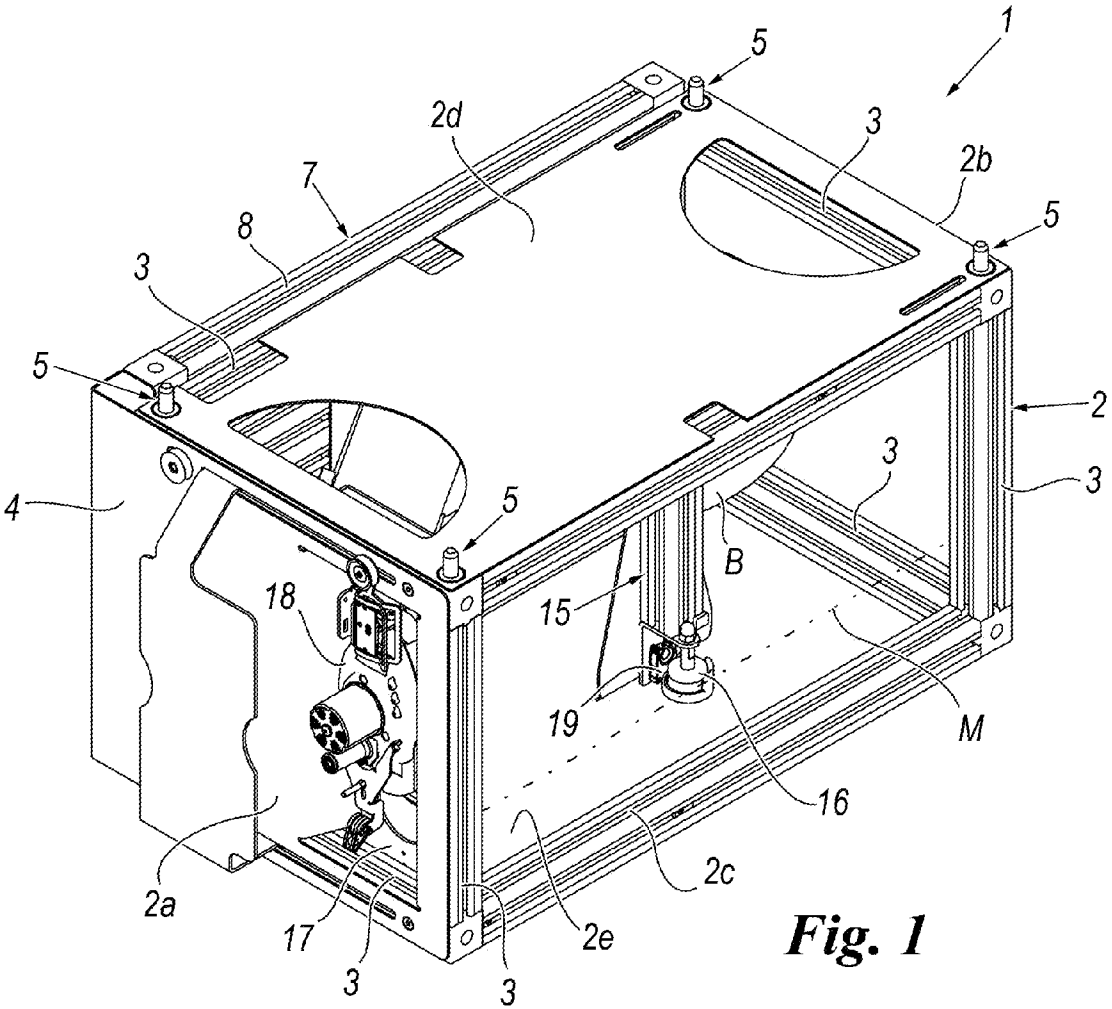
FIG. 1 is a perspective view of a modular element for a creel in accordance with the present invention according to a first operative condition.

With reference to the enclosed figures, reference number 1 indicates overall a modular element for a creel in accordance with the present invention.

The element 1 comprises a structure 2 which, in the illustrated embodiment, has polygonal solid shape.

In particular, the structure 2 has a front face 2*a*, there the yarn exits, a rear face 2*b*, opposite the front face 2*a*, two lateral faces 2*c*, an upper face 2*d* and a lower face 2*e*.

The structure 2 is delimited by profiles 3 mechanically connected to each other. The profiles 3 are arranged at the edges of the structure 2.

In the illustrated embodiment, the profiles 3 define four upper crosspieces, four lower crosspieces and four lateral uprights which connect the upper crosspieces with the lower crosspieces.

The structure 2 comprises a panel 4 arranged at the front face 2*a* and fixed to the four profiles 3 which define such face.

Coupling means 5 are arranged on the upper face 2*d* and on the lower face 2*e* in order to allow the coupling in vertical sense of a plurality of equivalent structures 2. By way of example, such coupling means 5 can be pins arranged on the upper face 2*d* and seats obtained in the lower face 2*e* in which they house the pins of another structure 2.

In addition, the coupling means 5 are arranged on the lateral faces 2*c* in order to allow the coupling in horizontal sense of a plurality of equivalent structures 2.

In this case, the coupling means 5 can be of mechanical type, such as fitting means, or of another type such as magnetic members.

The set of structures 2 can constitute a complex matrix or "molecular" structure where the single "atoms" are constituted by the structures 2 coupled together.

The structure 2 comprises at least one support 6 for supporting at least one package or bobbin of yarn "B".

In the preferred embodiment, the structure 2 comprises two supports 6, each for supporting at least one respective bobbin "B".

The bobbins "B" supported by the supports 6 have the respective threads connected to each other in "head-tail" mode, i.e. the start of the thread of one bobbin "B" is connected to the "tail" or end of the other bobbin "B".

The supports 6 are arranged along a direction that is extended from the rear face 2*b* to the front face 2*a*.

Figure 2:
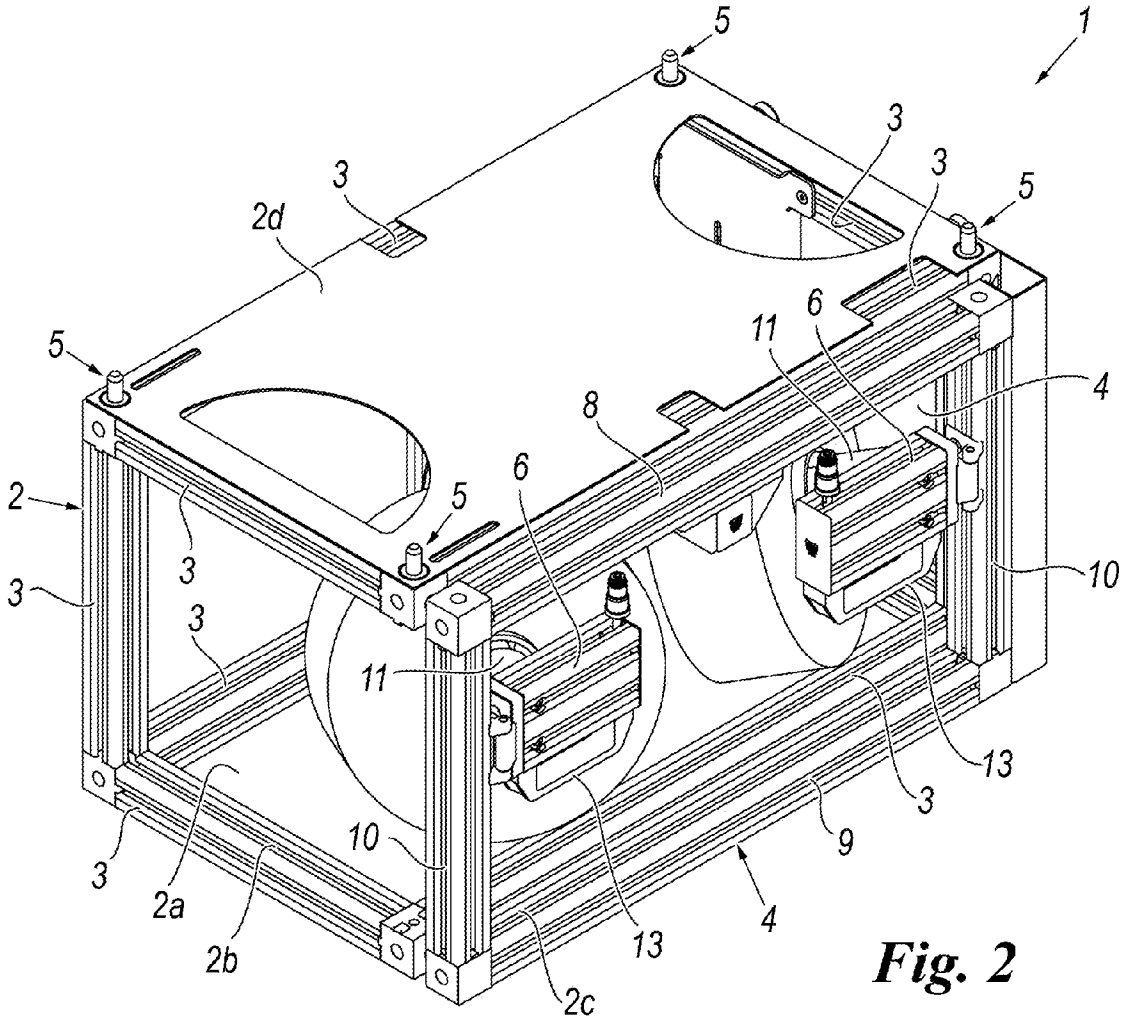
FIG. 2 illustrates a further perspective view of the element of FIG. 1 according to a different angle.
Figure 3:
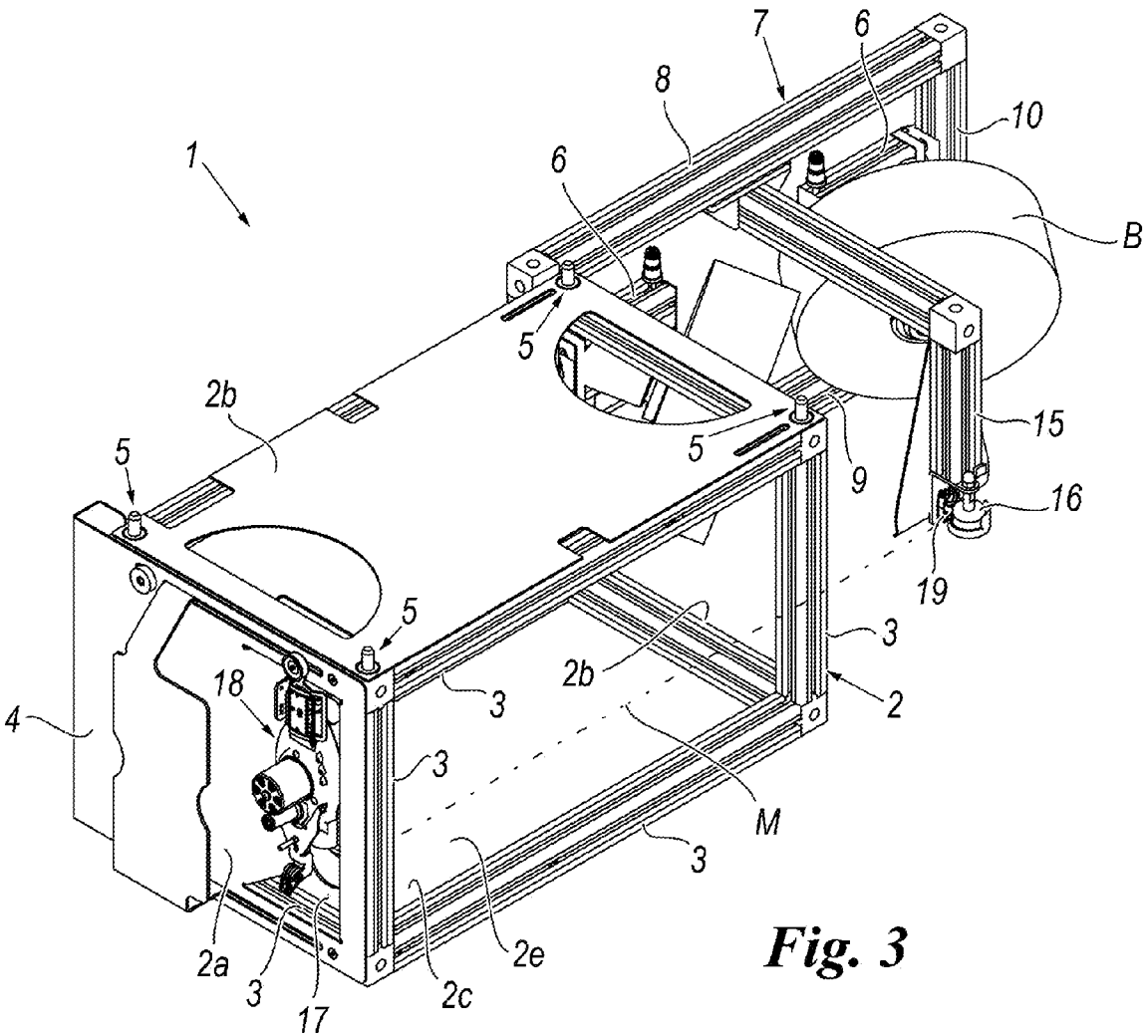
FIG. 3 illustrates a perspective view of the modular element for creel in a second operative condition.
Figure 4:
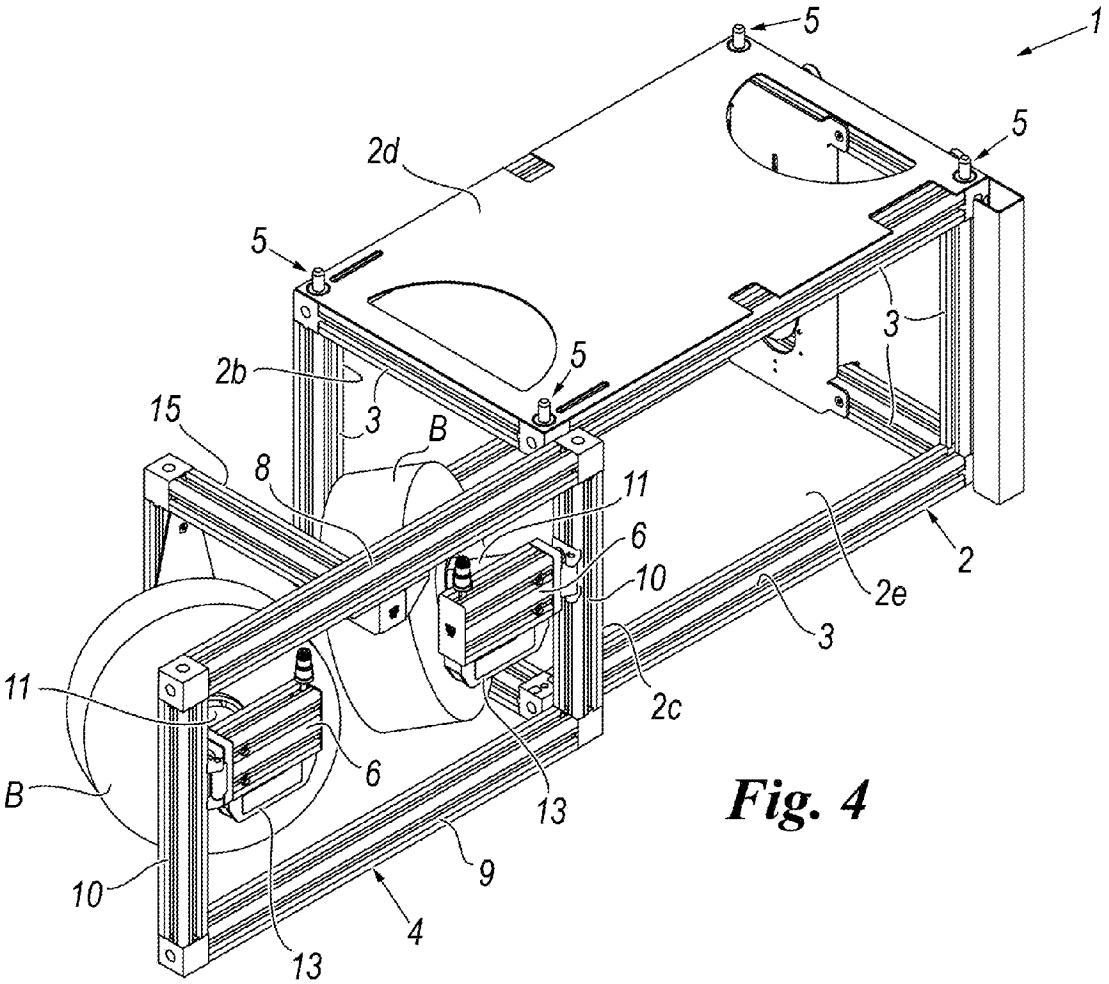
FIG. 4 illustrates a further perspective view of the element of FIG. 3 according to a different angle.

In accordance with the present invention, the supports 6 are movable between a position inside the structure 2 (FIGS. 1 and 2) and a position outside the structure 2 (FIGS. 3 and 4) parallel to a movement direction "M". The movement direction "M" is defined between the rear face 2*b* and the front face 2*a* of the structure 2. Preferably, the movement direction "M" is rectilinear. Preferably, the movement direction "M" is orthogonal to the front face 2*a* of the structure 2.

Advantageously, this allows accessing the supports 6 in an easy manner for the substitution of the bobbins "B", reducing the bulk.

The element 1 also comprises a slide 7 slidably associated with the structure 2. The slide 7 slides between a retracted position in which it is inside the structure 2 and an extracted position in which it is outside the structure 2.

The supports 6 are constrained to the slide 7 in a manner so as to allow the above-described movement.

In detail, the slide 7 slides parallel to the lateral faces 2*c* of the structure 2.

The slide 7 comprises a frame defined by an upper crosspiece 8 and a lower crosspiece 9, parallel to each other, and two lateral uprights 10 parallel to each other and orthogonally fixed to the upper crosspiece 8 and to the lower crosspiece 9.

The slide 7 slides along two guides (not illustrated) arranged along the profiles 3 which define the upper and lower crosspieces of one of the lateral faces 2*c*.

As said, the supports 6 are constrained to the slide 7. In particular, the supports 6 are constrained to the lateral uprights 10 of the slide 7.

According to that illustrated, each support 6 comprises an arm 11 rotatably fixed to the slide 7, each at a respective lateral upright 10. In detail, the arms 11 are hinged to the respective lateral uprights 10.

Figure 5:
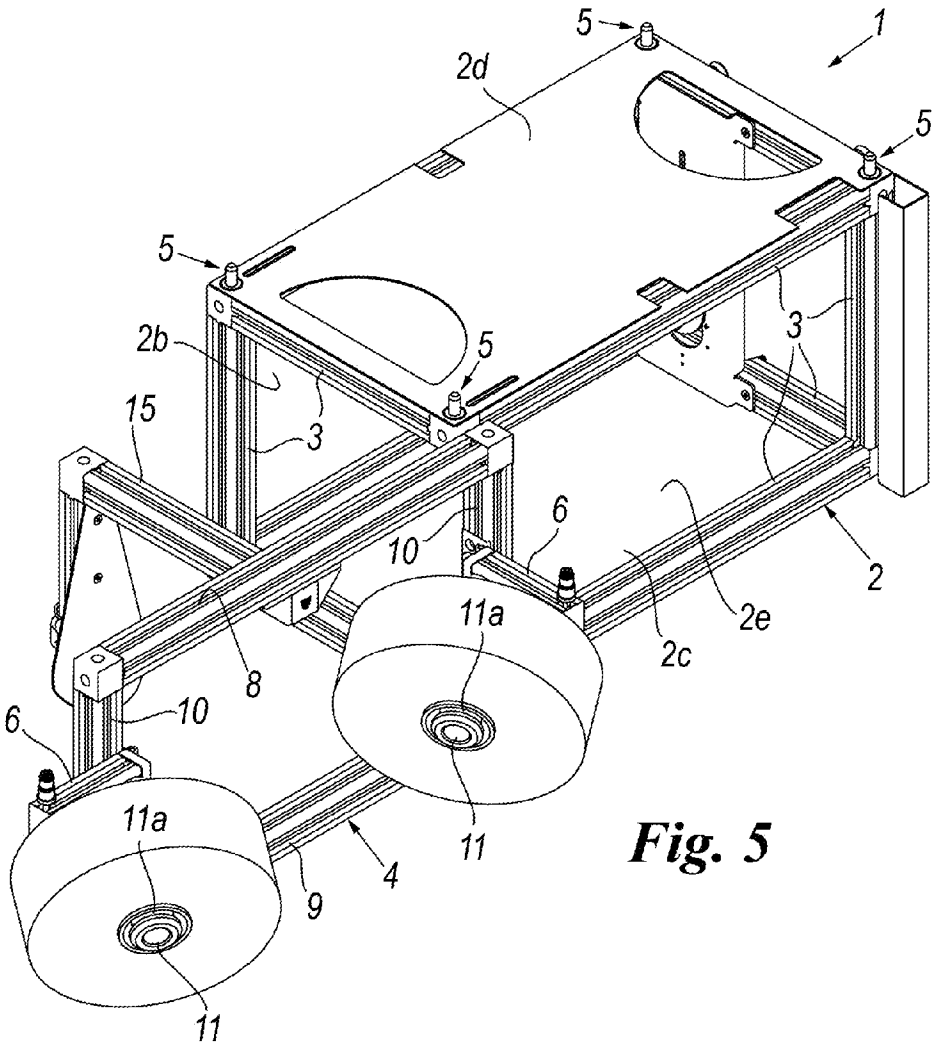
FIG. 5 illustrates a perspective view of the modular element for a creel according to a third operative condition.

When the slide 7 is in extracted position, the arms 11 are movable between an operative position, corresponding to a position that they assume when inserted in the structure 2 (FIG. 4), and a loading position in which they are rotated on the opposite side with respect to the frame of the slide 7 (FIG. 5).

In the loading position, once the bobbins have been used (in practice, the tubular support on which the yarn was wound), they are removed and substituted with full bobbins.

The slide 7 can comprise a handle (not illustrated) that allows a simple movement by a user.

The arms 11 have a projection 11*a* in proximity to their free end. In the operative position, the arms 11 are tilted downward in a manner such that the bobbins "B" maintain a stable position, in abutment via gravity against the projections.

In addition, the arms 11 are tilted towards each other in order to facilitate the unwinding of the yarn, as will be clarified below.

Each arm 11 comprises a handle 13 in order to allow grasping and rotating the arms 11.

Figure 6:
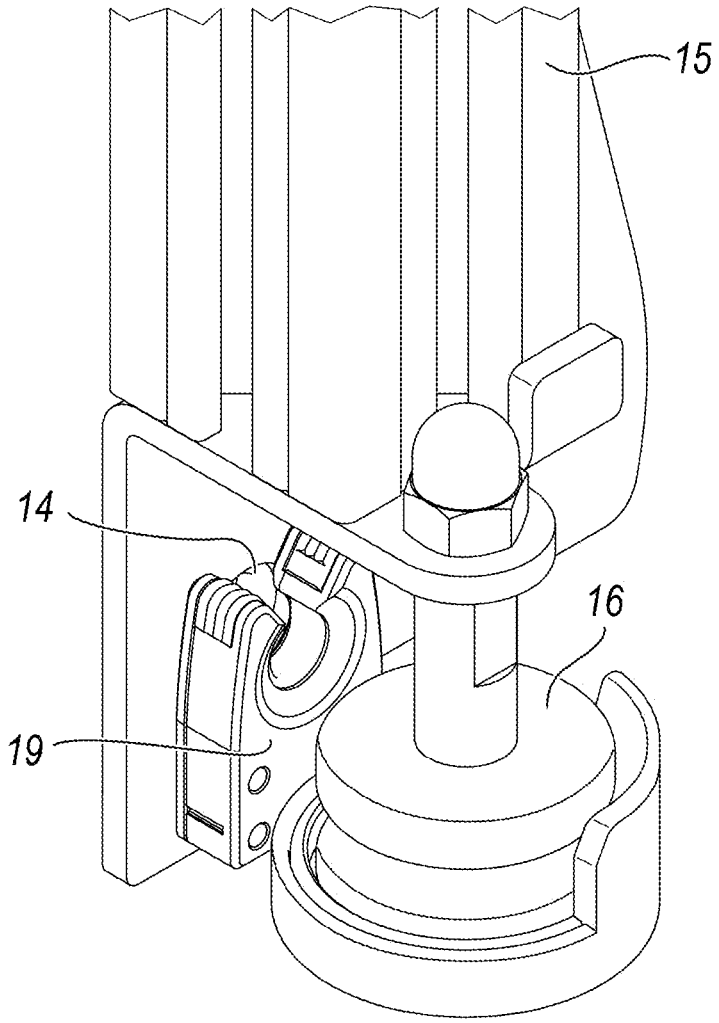
FIG. 6 illustrates an enlargement of a detail of the modular element for a creel.

The element 1 also comprises a guide eyelet 14 movable in an integral manner with the supports 6 (FIG. 6). In other words, the guide eyelet 14 is moved along a direction parallel to the movement direction "M".

The guide eyelet 14 is frontally arranged with respect to the supports 6 in a position substantially equidistant therefrom.

The arms 11 are tilted in a manner such that their main extension axes converge towards the guide eyelet 14. In such a manner, the unwinding of the yarn from the bobbins defines a centered cone with the guide eyelet 14. Thus, the unwinding conditions are maintained constant, even independent of the bobbin "B" being wound.

For such purpose, a support body 15 is constrained, at a first end thereof, to the slide 7 and bears, in proximity to a second end thereof, the guide eyelet 14.

In detail, the support body 15 has substantially L-shaped form and its first end is constrained to the upper crosspiece 8 of the slide 7.

Downstream of the guide eyelet 14, a transfer wheel 16 is arranged on which the yarn, coming from the bobbins "B" and exiting from the guide eyelet 14, is partially wound before exiting from the module 1.

The transfer wheel 16 is preferably at least partly made of ceramic material. By way of example, the transfer wheel 16 is covered with ceramic material.

In order to allow the exit of the yarn from the module 1, an outlet eyelet 17 is arranged on the panel 4 defining the front face 2*a* of the structure 2, at a corresponding hole.

Advantageously, the transfer wheel 16 remains substantially aligned with the outlet eyelet 17. In this manner, the lying position of the yarn between the transfer wheel 16 and the outlet eyelet 17 remains substantially unchanged when the slide 7 is extracted or retracted.

This allows extracting or retracting the slide 7 even during the operation of the element 1.

The element 1 also comprises a feeding device 18 for the yarn in order to draw the yarn from the bobbins "B" and supply it to the textile machine.

The feeding device 18 is fixed to the panel 4 in proximity to the outlet eyelet 17.

The feeding device 18 is preferably of the type adapted to feed the thread to the textile machine, in a continuous or discontinuous manner, with constant tension and/or velocity. The control is carried out by the device itself. Of course, the latter can be arranged in another position on the structure 2.

The element 1 also comprises an active sensor 19 on the yarn for detecting, instant by instant, which of the two bobbins "B" is actually being wound.

The sensor 19 can, by way of example, be of the type described in the Italian patent application MI2011A001252 on behalf of the same Applicant.

Such sensor 19 therefore generates a signal representative of the bobbin "B" actually being wound.

Such signal is sent to a control unit. Such control unit can be integrated in a control unit for the feeding device 18. Alternatively, the control unit is independent.

The signal is therefore processed in order to generate a signal representative of the change of bobbin. In other words, when the yarn of one bobbin terminates and the unwinding of the other bobbin starts, the sensor 19 detects such change and the control unit generates the signal representative of the change of bobbin.

The control unit comprises a display device (not illustrated) that displays such signal, indicating to the operator the possibility to substitute the terminated bobbin with a new one.

The sensor 19 is also capable of verifying the absence of yarn following, for example, a breakage of the yarn.

In such case, the sensor 19 generates a signal representative of the absence of thread and sends it to the control unit, which signals the occurrence by means of the display device.

The sensor 19 is arranged at the guide eyelet 14. In detail, the sensor 19 is constrained at the second end of the support body 15, immediately downstream of the guide eyelet 15. In addition, the sensor 19 is placed immediately upstream of the transfer wheel 16.

The injection described above achieves the pre-established object.

Indeed, since the supports for the bobbins can be extracted from the structure in order to allow the substitution of the bobbins, it is possible to reduce the bulk, above all when it is necessary to place a high number of modules side by side.

In addition, also the arrangement of the supports for the bobbins along the movement direction allows further reducing the bulk.

The invention claimed is:

1. A modular element for a creel comprising:

a structure having at least one support for supporting a package or bobbin of yarn; said structure being modularly couplable to other similar structures to allow the feeding of multiple yarns to a textile machine;

a feeding device for the yarn to draw the yarn from said bobbin and supply the yarn to said textile machine;

wherein said support being movable parallel to a movement direction, defined from a rear face to a front face of the structure, between a position inside the structure and a position outside the structure; said element also comprising a guide eyelet movable integrally with the support along a direction parallel to said movement direction and a transfer wheel integral with the guide eyelet; said element also comprising an outlet eyelet constrained to said structure; said transfer wheel being movable in alignment with said outlet eyelet.

2. The element according to claim 1, comprising a slide slidably associated with the structure, said support being constrained to said slide.

3. The element according to claim 1, comprising two supports for supporting two bobbins connectable to each other in head-tail mode and movable along said movement direction.

4. The element according to claim 3, comprising a slide slidably associated with the structure, said support being constrained to said slide, wherein said supports are both connected to the slide.

5. The element according to claim 4, wherein said supports are arranged along a direction parallel to said movement direction.

6. The element according to claim 3, wherein said supports are arranged along a direction parallel to said movement direction.

7. The element according to claim 3, comprising a slide slidably associated with the structure, said support being constrained to said slide, wherein each support comprises an arm for supporting the bobbin, said arm being rotatably connected to the slide and movable between an operative position and a loading position.

8. The element according to claim 3, wherein said guide eyelet is substantially equidistant from said supports.

9. The element according to claim 1, further comprising a sensor for detecting the origin of the yarn and signaling the change of bobbin.

10. The element according to claim 9, wherein said sensor is arranged at said guide eyelet and is integral therewith.

* * * * *